US006880175B2

(12) United States Patent
Tajima et al.

(10) Patent No.: US 6,880,175 B2
(45) Date of Patent: Apr. 19, 2005

(54) WAIST EXPANDING AND CONTRACTING STRUCTURE FOR PANTS OR THE LIKE

(75) Inventors: Kazuhiko Tajima, Tokyo (JP); Shoko Okuda, Tokyo (JP)

(73) Assignee: Kabushiki Kaisha Phenix, Tokyo (JP)

( * ) Notice: Subject to any disclaimer, the term of this patent is extended or adjusted under 35 U.S.C. 154(b) by 109 days.

(21) Appl. No.: 10/025,587

(22) Filed: Dec. 26, 2001

(65) Prior Publication Data

US 2002/0138895 A1 Oct. 3, 2002

(30) Foreign Application Priority Data

Mar. 28, 2001 (JP) ..... 2001-093108

(51) Int. Cl.[7] ..... A41F 1/00
(52) U.S. Cl. ..... 2/237; 2/221
(58) Field of Search ..... 2/235–237, 227, 2/228, 238, 211, 220, 221, 247.251

(56) References Cited

U.S. PATENT DOCUMENTS

| | | | | |
|---|---|---|---|---|
| 1,078,950 A | * | 11/1913 | Peine | 2/237 |
| 2,569,853 A | * | 10/1951 | Grue | 2/237 |
| 2,599,983 A | | 6/1952 | Fanning | 2/237 |
| 3,098,238 A | | 7/1963 | Diamond | 2/237 |
| 4,596,055 A | * | 6/1986 | Aach et al. | 2/237 |
| 5,067,176 A | * | 11/1991 | Carabillo | 2/237 |
| 5,544,366 A | | 8/1996 | Kato | 2/237 |

FOREIGN PATENT DOCUMENTS

| | | |
|---|---|---|
| CH | 494 546 | 9/1968 |
| GB | 416235 | 9/1934 |
| JP | 2578079 | 11/1996 |
| JP | 11-181604 | 7/1998 |
| JP | 11-181604 | 7/1999 |
| JP | 3069120 | 3/2000 |

OTHER PUBLICATIONS

Copy of European Patent Office Communication and Search Report for corresponding European Patent Application 02000205 dated Jun. 6, 2003.

* cited by examiner

*Primary Examiner*—Gloria M. Hale
(74) *Attorney, Agent, or Firm*—Armstrong, Kratz, Quintos, Hanson & Brooks, LLP

(57) ABSTRACT

In a waist expanding and contracting structure for pants or the like of a type having waist pockets, a waist part 1 consists of a front waist part 2, a back waist part 3, and a side waist part 4. The structure includes a first elastic member 14 which is positioned between a front waist surface cloth 6 and a front waist reverse cloth 8 with its one end sewn to the side waist part and with its other end sewn to both the front waist surface cloth and the front waist reverse cloth by sewing together, and a second elastic member 15 which is positioned at the rear of the side waist part 4 with its one end sewn to the back waist part 3 and with its other end sewn to the front waist reverse cloth 8. A side cloth 13 is folded back to be sewn to a hemmed edge P1 of the waist pocket, and a pocket bag 17 to be opened and closed by a fastener 16 is provided between the front body part 5 and a reverse cloth 7 of the front body part.

5 Claims, 7 Drawing Sheets

WAIST EXPANDING AND CONTRACTING STRUCTURE FOR PANTS OR THE LIKE

BACKGROUND OF THE INVENTION

1. Field of the Invention

The present invention relates to a structure for expanding and contracting a waist part of articles of clothing including pants, culottes, skirt, etc. of a type having waist pockets.

2. Description of the Related Art

Among conventional expanding and contracting structures for pants or the like in which the waist part of the pants or the like is provided with an elastic member, there has been proposed such a structure that a front waist part at an upper end of a front body part and a back waist part at an upper end of a back body part are adapted to be expanded and contracted in a sliding manner, so that the elastic member may not be exposed by the expanding and contracting action, and an appearance of the pants can be improved. There have been also proposed various forms for improving the above described structure, for example, in Japanese Patent No. 2578079, Japanese Utility Model Registration No. 3069120, and so on. The applicant too has proposed, in Japanese Patent Laid-open Publication No. 11-181604, a waist expanding and contracting structure for pants or the like which is an improvement of the prior art.

The conventional waist expanding and contracting structure for pants or the like has had such a problem that the waist pockets may change in depth as the waist part is expanded or contracted, and when the waist part is stretched, the waist pockets may become shallow and contents inside the pockets may be exposed and drop.

Moreover, in the conventional structure, when the waist pockets have become shallow, openings of the waist pockets are largely inclined at the same time, and water or dust may become likely to intrude into the pockets.

In view of the above drawbacks, it is an object of the present invention to provide a waist expanding and contracting structure for pants or the like in which depth and width of waist pockets may not change even when the waist part is expanded or contracted, and the pockets may be dummy pockets while fasteners are closed, without a risk of intrusion of water or dust.

SUMMARY OF THE INVENTION

According to the present invention, there is provided a waist expanding and contracting structure for pants or the like of a type having waist pockets comprising, a waist part consisting of a front waist part, a back waist part, and a side waist part, the front waist part being composed of a front waist surface cloth sewn to an upper end of a front body part and a front waist reverse cloth sewn to an upper end of a reverse cloth of the front body part, both of which are joined together at their upper edges by sewing, the back waist part being composed of aback waist surface cloth sewn to an upper end of a back body part and a back waist reverse cloth sewn to an upper end of a reverse cloth of the back body part, both of which are joined together at their upper edges by sewing, the side waist part being arranged so as to be positioned between the front waist surface cloth and the front waist reverse cloth, and formed at an upper end of a side cloth of the waist pocket, wherein the structure includes a first elastic member which is positioned between the front waist surface cloth and the front waist reverse cloth with its one end sewn to the side waist part and with its other end sewn to both the front waist surface cloth and the front waist reverse cloth by sewing together, a second elastic member which is positioned at the rear of the side waist part with its one end sewn to the back waist part and with its other end sewn to the front waist reverse cloth, the side cloth being folded back to be sewn to a hemmed edge of the waist pocket, and a pocket bag to be opened and closed by a fastener which is provided between the front body part and the reverse cloth of the front body part.

Because the pants or the like are provided with the reverse cloths, they are excellent in touch, strength and as protection against the cold. Moreover, because each the side cloth is folded back to be sewn to the hemmed edge of the waist pocket, and the pocket bag to be opened and closed by the fastener is provided between the front body part and the reverse cloth of the front body part, depth and width of the waist pocket will not change even if the waist part is expanded or contracted. Further, the pocket will be a dummy pocket while the fastener is closed, and there will be no risk of intrusion of snow, water, dust, etc. The waist pocket will be a hidden pocket which can be used as the waist pocket having a determined depth and width, by opening the fastener. By providing the fastener behind the hemmed edge of the waist pocket, the fastener will not be exposed to the exterior when the waist part is expanded or contracted, and the appearance will be improved.

According to another aspect of the present invention, the structure includes a waist belt which is sewn to a part of the back waist part at its one end, and a ring for allowing the waist belt to pass therethrough which is attached to an end of the front waist surface cloth by means of a third elastic member, whereby the waist belt which has been adjusted in length can be expanded or contracted.

By adjusting the waist belt which has been passed through the ring to a determined length, a size of the waist part will be determined. Because the ring is attached to an end of the front waist surface cloth by means of the third elastic member, the adjusted waist belt can be further expanded or contracted, and feeling of pressure will be moderated. Even if the waist part changes more than the size determined by the waist belt during an exercise or so, the change can be absorbed.

According to still another aspect of the present invention, there is formed a gathered portion by sewing a fourth elastic member to a part of the back waist part, and an end of the waist belt is sewn to an end of the gathered portion thereby to cover the gathered portion.

In this manner, the back waist part is adjusted by expansion and contraction by means of the gathered portion, and the gathered portion is covered with the waist belt to attain a good appearance.

According to a further aspect of the present invention, the side waist part is provided with a belt loop, and the waist belt is adapted to be folded back at the ring, after the waist belt has passed through the belt loop.

This facilitates the waist belt to be positioned without vertical misalignment, and to be tightly fitted to a user's waist, thereby increasing stability and securing performance.

According to a still further aspect of the present invention, the waist belt is adapted to be fastened or released by means of a Velcro fastener having both male and female loops.

In this manner, the Velcro fastener having both male and female loops can be attached to entire mating faces of the waist belt. Accordingly, the waist belt which has been folded back at the ring can be overlapped at a desired position to be fastened or detached, and can be appropriately adjusted according to a size of the user's waist and a desired size.

DESCRIPTION OF THE PREFERRED EMBODIMENTS

Figure 1:
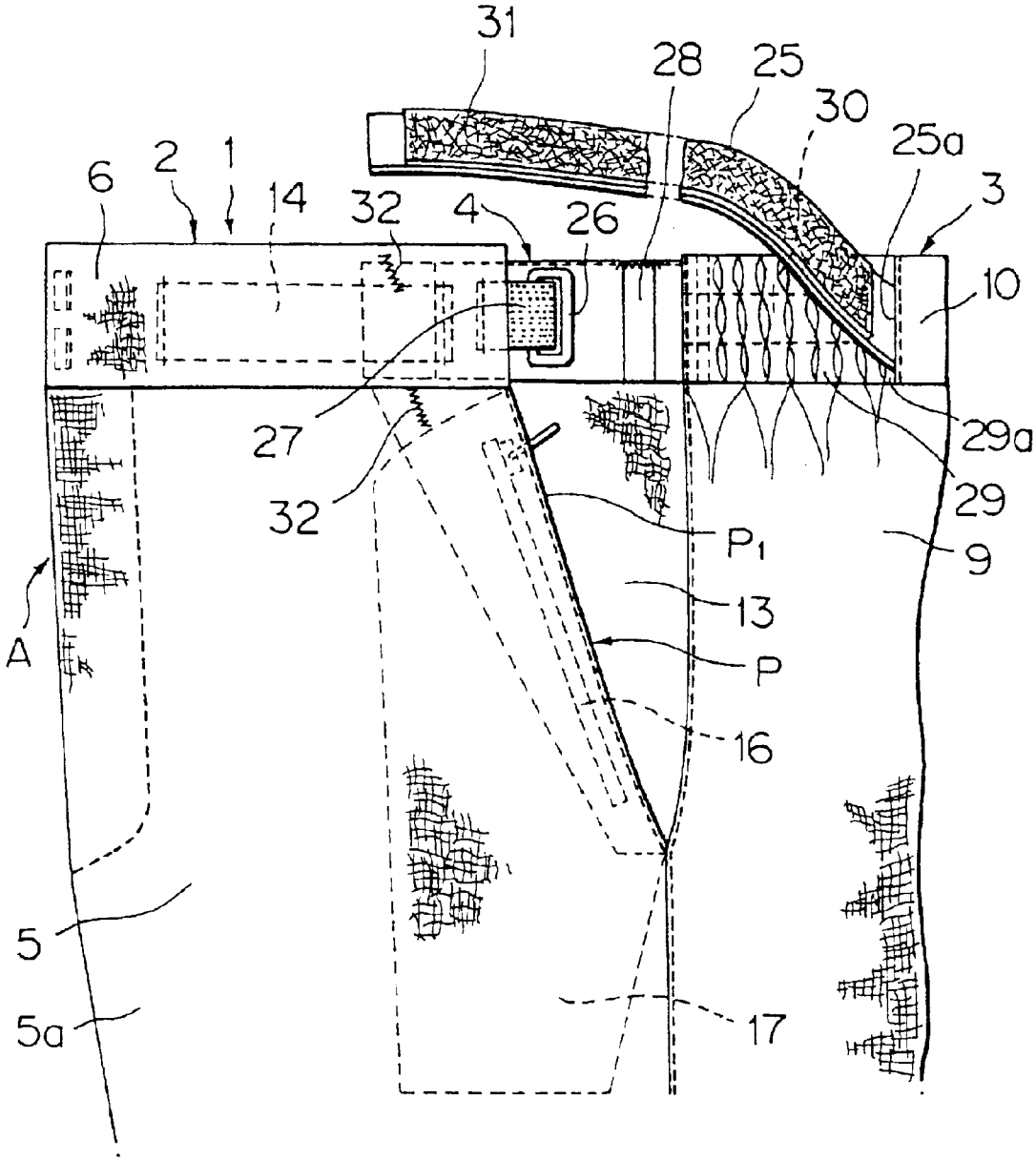
FIG. 1 is a perspective view showing an essential part of a waist part of pants having an expanding and contracting structure in one embodiment according to the present invention.
Figure 2:
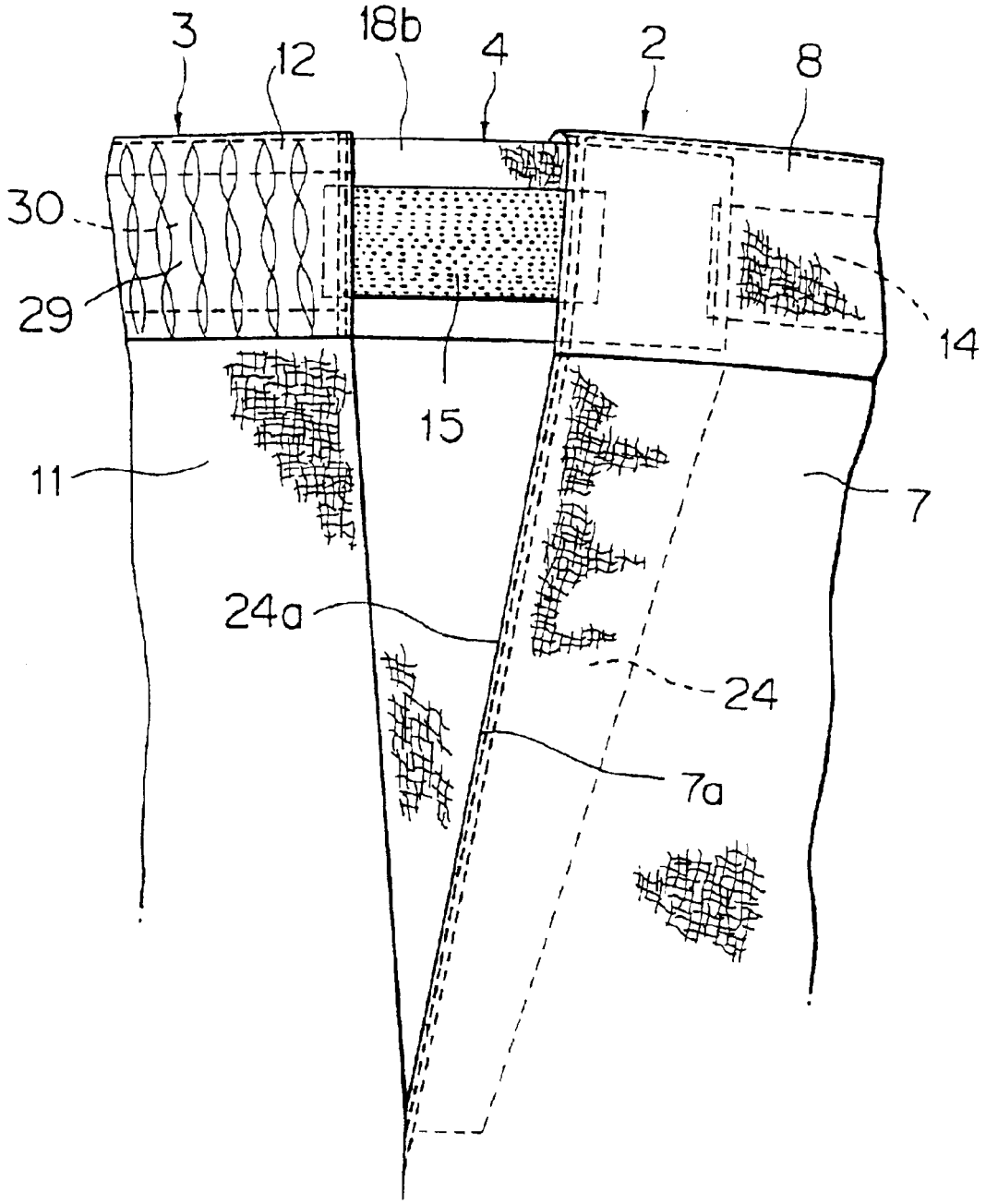
FIG. 2 is a rear view of the waist part having the expanding and contracting structure.

In the drawings, numeral A represents pants having a waist pocket P. The pants A has a waist expanding and contracting structure in which elastic members are arranged on a waist part 1. The waist part 1 consists of a front waist part 2, a back waist part 3, and side waist parts 4, only one of which is shown in the drawings. The front waist part 2 is composed of a front waist surface cloth 6 attached to an upper end of a front body part 5 and a front waist reverse cloth 8 attached to an upper end of a reverse cloth 7 of the front body part 5 as shown in FIG. 2, both of which are joined together at their upper edges by sewing. The back waist part 3 is composed of a back waist surface cloth 10 attached to an upper end of a back body part 9 and a back waist reverse cloth 12 attached to an upper end of a reverse cloth 11 of the back body part 9 as shown in FIG. 2, both of which are joined together at their upper edges by sewing. The side waist part 4 is arranged to be positioned between the front waist surface cloth 6 and the front waist reverse cloth 8 and formed at an upper end of a side cloth 13 of the waist pocket P.

The waist expanding and contracting structure includes a first elastic member 14 which is positioned between the front waist surface cloth 6 and the front waist reverse cloth 8, with its one end sewn to the side waist part and with its other end sewn to both the front waist surface cloth 6 and the front waist reverse cloth 8 by sewing together. The waist expanding and contracting structure further includes a second elastic member 15 which is positioned at the rear of the side waist part 4 as shown in FIG. 2, with its one end sewn to the back waist part 3 and with its other end sewn to the front waist reverse cloth 8. The side cloth 13 is folded back and sewn to a hemmed edge P1 of the waist pocket P. A fastener 16 is provided behind the hemmed edge P1, and a pocket bag 17 to be opened and closed by the fastener 16 is provided between the front body part 5 and the reverse cloth 7 of the front body part 5.

Figure 4:
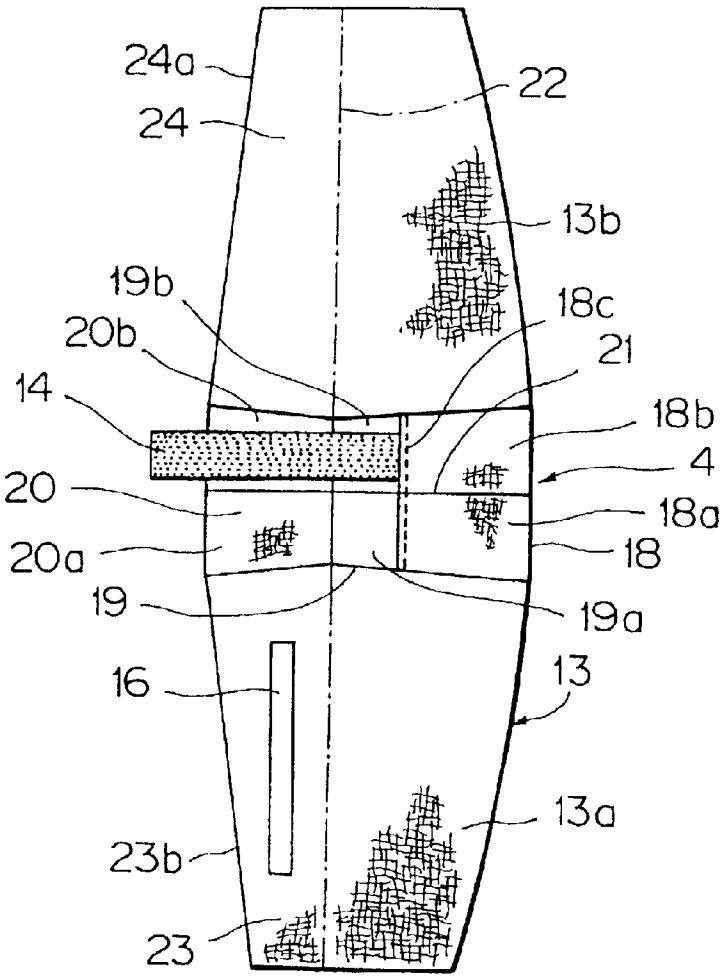
FIG. 4 is a plan view of a side cloth and the side waist part in a developed state.
Figure 3:
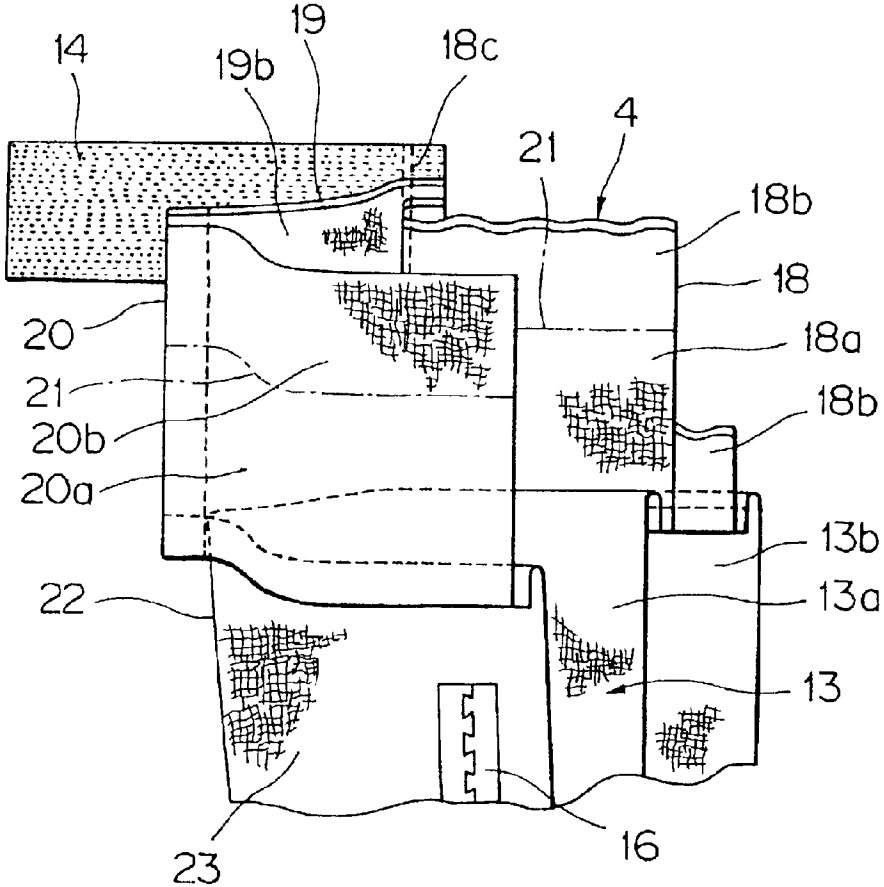
FIG. 3 is an exploded perspective view showing relation between a side waist part and a first elastic member.

In this embodiment, the side cloth 13 and the side waist part 4 are constructed as shown in FIGS. 3 to 6. The side cloth 13 is composed of a side surface cloth 13*a* and a side reverse cloth 13*b* formed in symmetry to each other as shown in FIG. 4. The side surface cloth 13*a* and the side reverse cloth 13*b* are joined together with their seams inside as shown in FIG. 3. Meanwhile, the side waist part 4 includes a side waist cloth 18 and connecting pieces 19, 20 which are respectively sewn to upper ends of the side surface cloth 13*a* and the side reverse cloth 13*b*.

When the side cloth 13 is folded back at a folding line 22, a cloth 23 on a front side is adapted to serve as a reverse cloth 23*a* of a dummy pocket which is shallow in depth, and an edge 23*b* of the cloth 23 is sewn to the hemmed edge P1 of the pocket P. On the other hand, a cloth 24 on a reverse side is folded and its edge 24*a* is adapted to be sewn to an edge 7*a* of the reverse cloth 7 of the front body part 5, as shown in FIG. 2.

Figure 5:
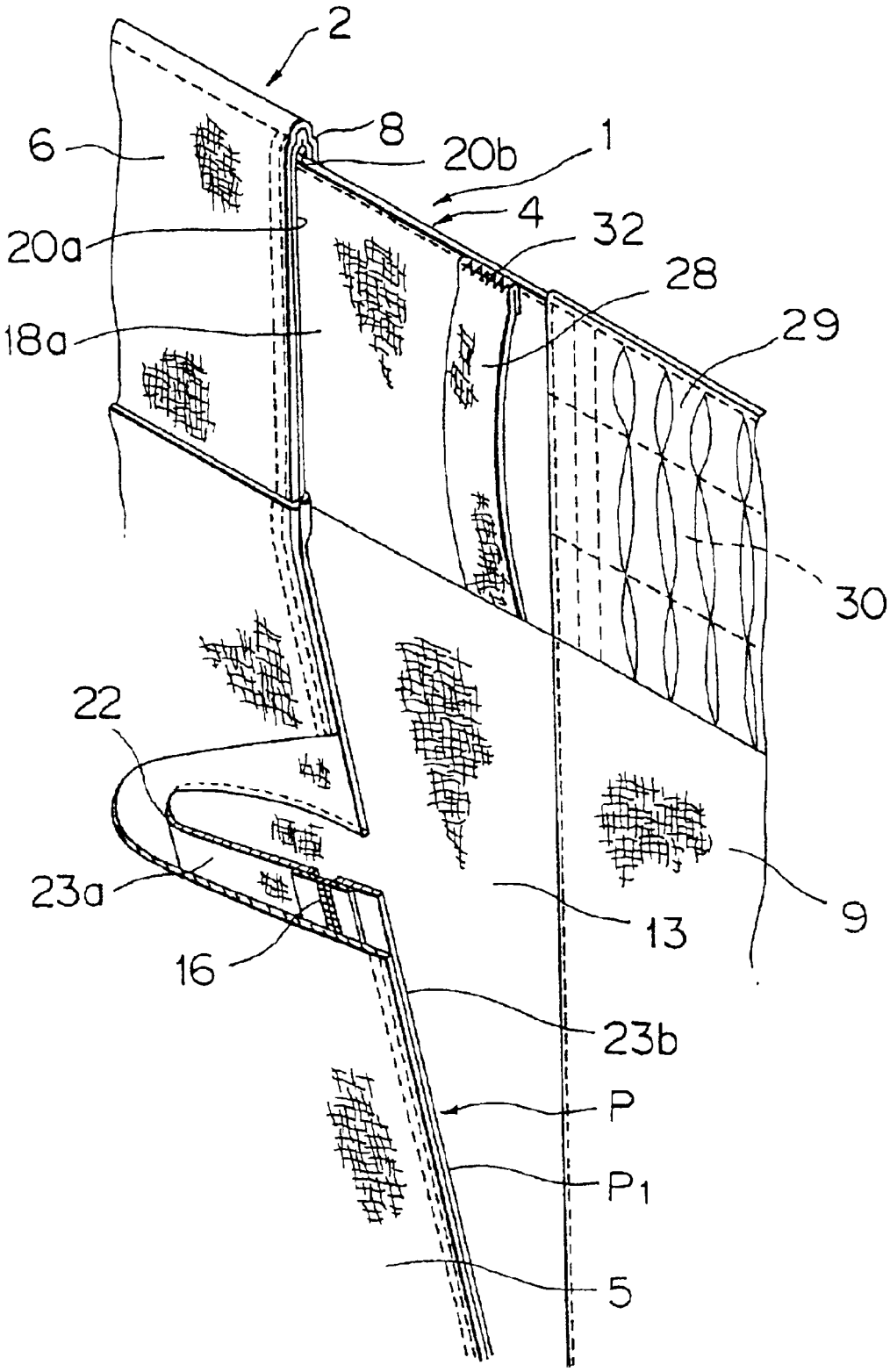
FIG. 5 is a perspective view partly cut away showing a structure of the side waist part.
Figure 6:
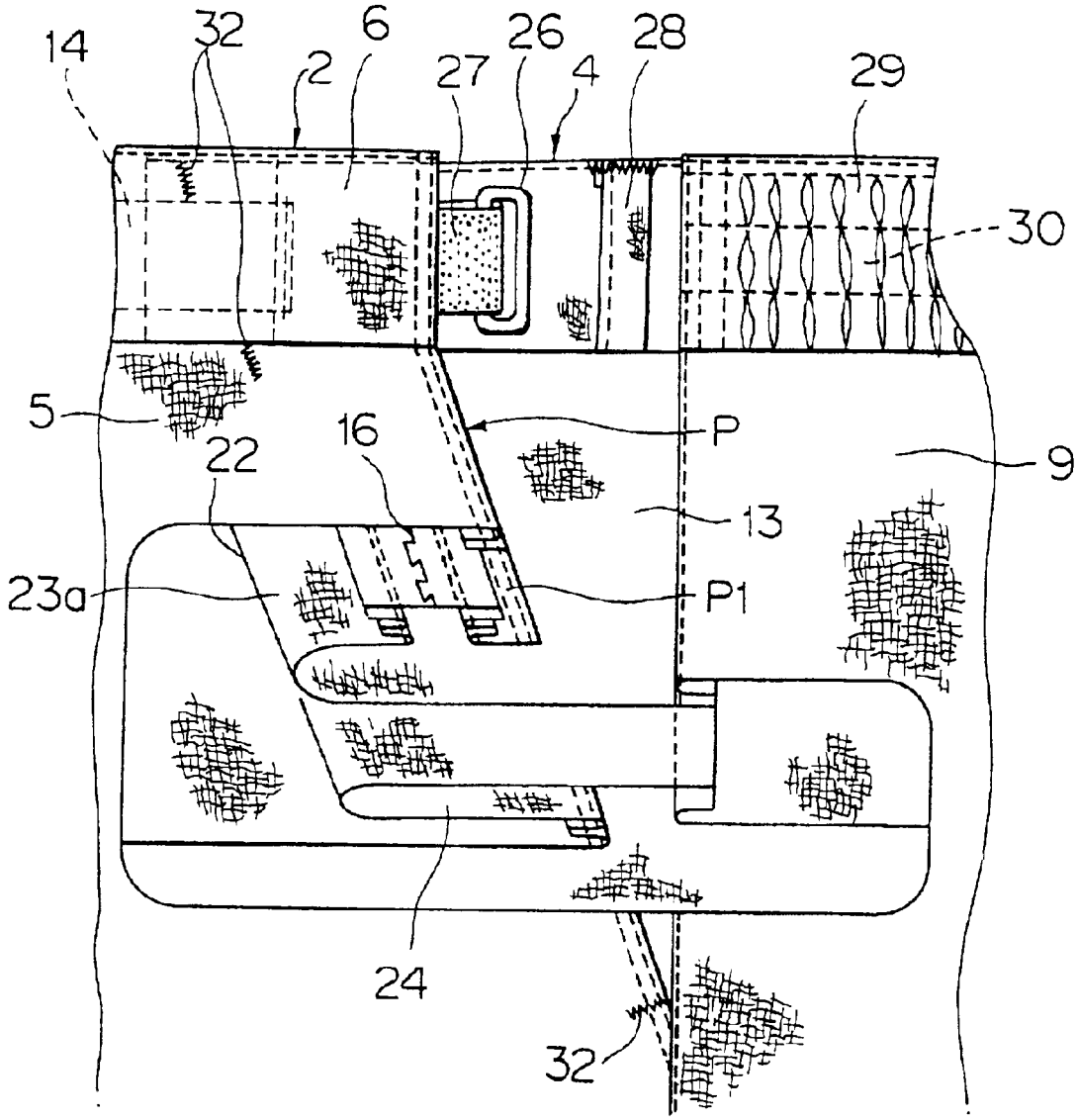
FIG. 6 is a perspective view showing the structure of the side waist part in a simplified form.

When the side cloth 13 is folded back at a folding line 21, there will be formed a side waist surface cloth 18*a*, a connecting piece surface cloth 19*a*, and a side waist reverse cloth 18*b*, and a connecting piece reverse cloth 19*b*. Preferably, one end of the first elastic member 14 is sewn in advance to a connecting portion 18*c* between the side waist reverse cloth 18*b* and the connecting piece reverse cloth 19*b*. Thus, the first elastic member 14 is sandwiched between the connecting piece surface cloth 19*a* and the connecting piece reverse cloth 19*b*, when the side cloth has been folded back at the folding line 21. As shown in FIGS. 4 and 5, a surface cloth 20*a* of the connecting piece 20 is sewn as an underlining of the front waist surface cloth 6, while a reverse cloth 20*b* of the connecting piece 20 is sewn as an underlining of the front waist reverse cloth 8.

One end 25*a* of a waist belt 25 is sewn to a part of the back waist part 3, specifically in this embodiment, a starting end 29*a* of a gathered portion 29 which will be described below. A ring 26 for allowing the waist belt 25 to pass therethrough is attached to an end of the front waist surface cloth 6 by means of a third elastic member 27, so that the waist belt 25 which has passed through the ring 26 and has been adjusted in length can be expanded or contracted. In FIG. 5, the third elastic member 27 and the ring 26 are omitted for convenience of explanation. The pocket bag 17 is also omitted.

The gathered portion 29 is formed by sewing a fourth elastic member 30 to a part of the back waist part 3, specifically in this embodiment, adjacent to a connecting portion to the side waist part 4. The gathered portion 29 is adapted to be covered with the waist belt 25 which has been sewn to the starting end 29*a* of the gathered portion 29.

Further, the side waist part 4 is provided with a belt loop 28. The waist belt 25 is adapted to be folded back at the ring 26, after the waist belt 25 has passed through this belt loop 28. A Velcro fastener 31 having both male and female loops is sewn to the waist belt 25, so that the waist belt 25 can be fastened or detached at a desired position by overlapping one face of the waist belt 25 on another. Numeral 32 represents bar tacks.

Figure 7:
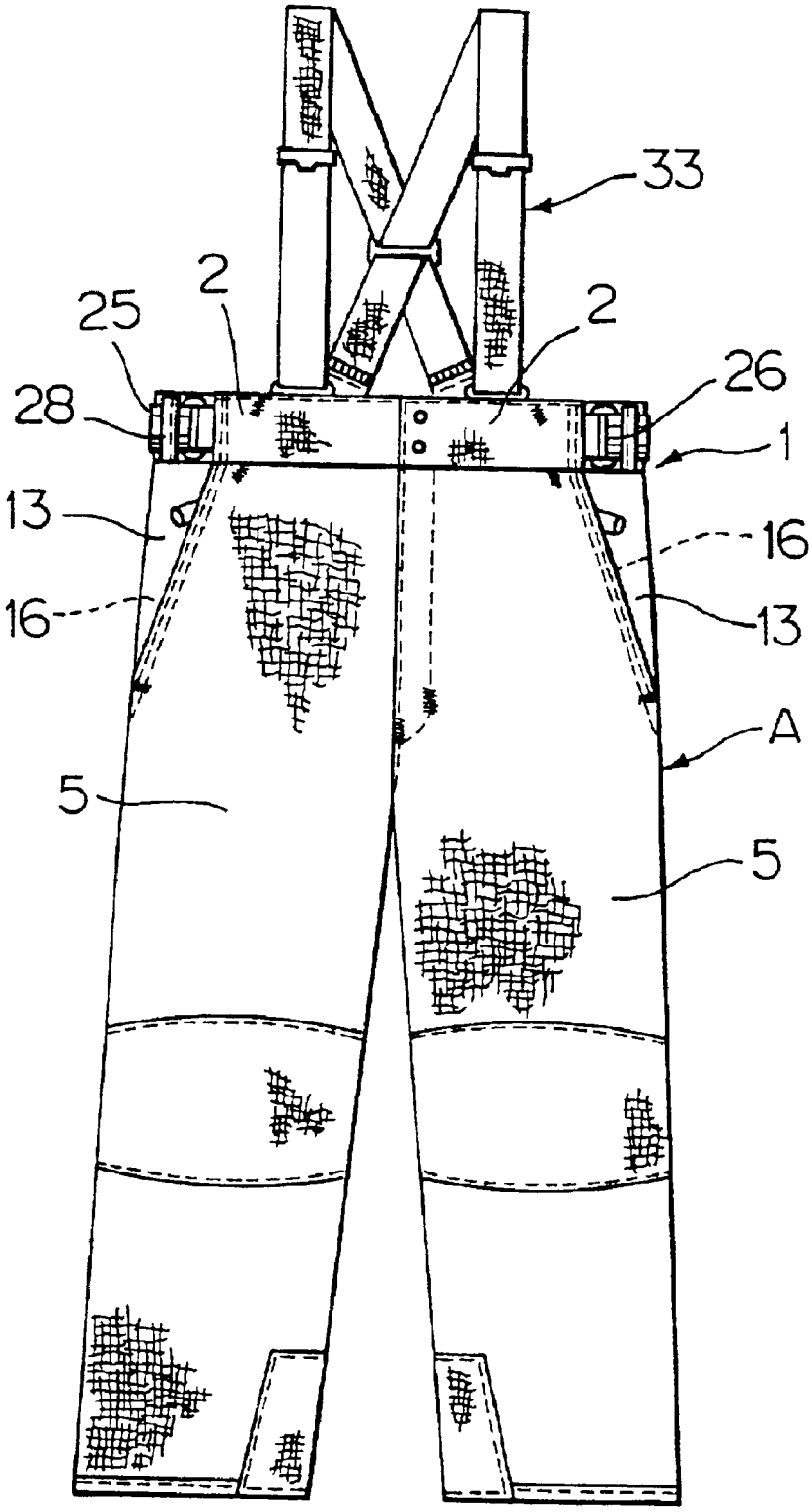
FIG. 7 is a front view of pants provided with suspending belts to which the present invention is applied.
Figure 8:
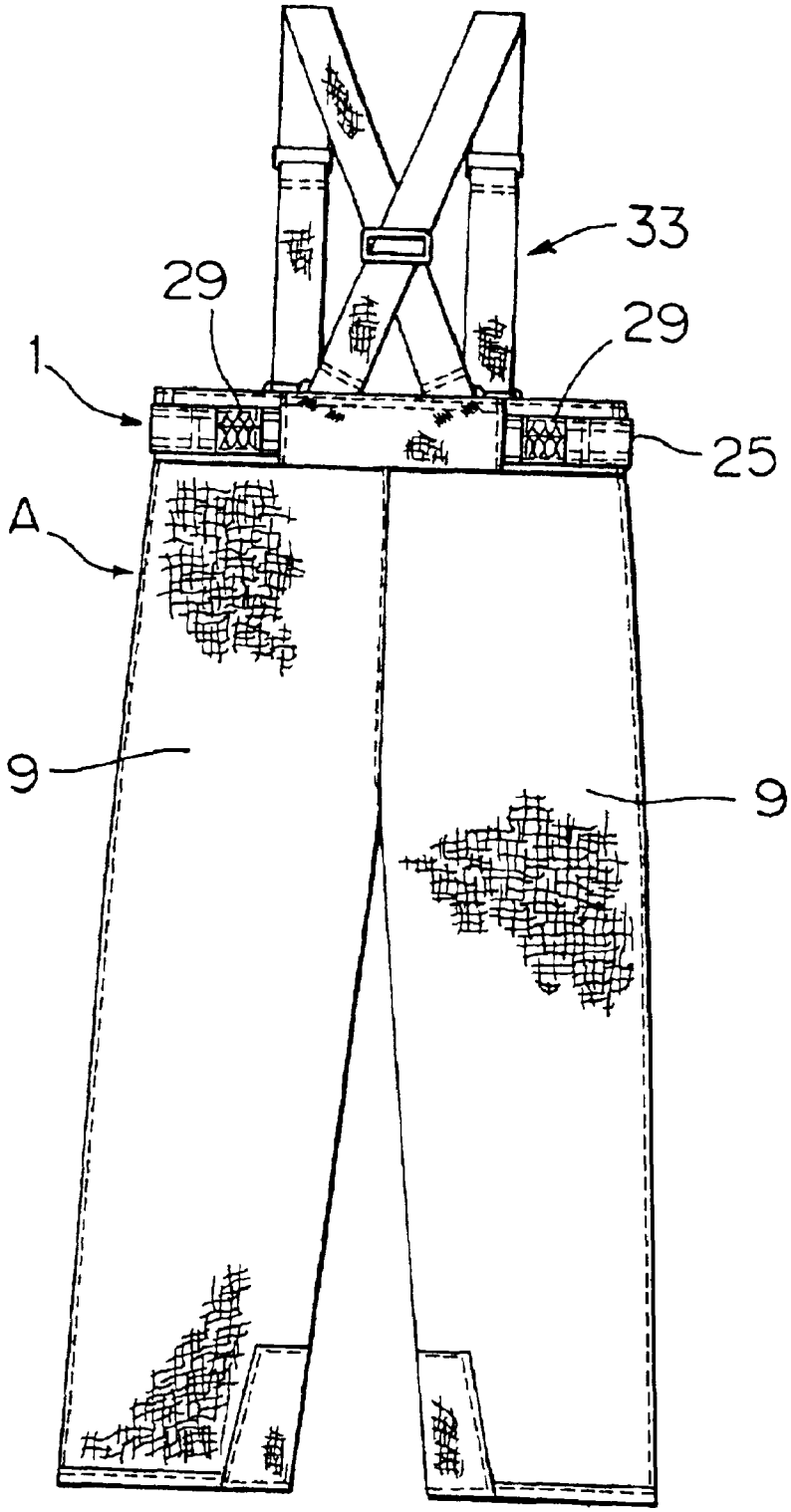
FIG. 8 is a rear view of the pants provided with the suspending belts.

FIGS. 7 and 8 show pants provided with a pair of suspending belts 33 to which the waist expanding and contracting structure for pants or the like according to the present invention is applied. However, the invention can be applied not only to the pants, but also to culottes, skirt, etc.

Although the present invention has been fully described by way of examples with reference to the accompanying drawings, it is to be noted that various changes and modifications can be made within a scope of the present invention.

What is claimed is:

1. A waist expanding and contracting structure for an article of clothing having waist pockets comprising;

a waist part consisting of a front waist part, a back waist part, and a side waist part, said front waist part being composed of a front waist surface cloth sewn to an upper end of a front body part and a front waist reverse cloth sewn to an upper end of a reverse cloth of said front body part, both of said front waist surface cloth and said front waist reverse cloth being joined together at upper edges thereof by sewing, said back waist part being composed of a back waist surface cloth sewn to an upper end of a back body part and a back waist reverse cloth sewn to an upper end of a reverse cloth of said back body part, both of said back waist surface cloth and said back waist reverse cloth being joined together at the upper edges thereof by sewing, said side waist part being arranged so as to be positioned between said front waist surface cloth and said front waist reverse cloth, and formed at an upper end of a side cloth of said waist pocket, wherein said structure includes a first elastic member which is positioned between said front waist surface cloth and said front waist reverse cloth with one end of said first elastic member being sewn to said side waist part and with the other end of said first elastic member being sewn to both said front waist surface cloth and said front waist reverse cloth, a second elastic member which is positioned at a rear of said side waist part with one end of said second elastic member being sewn to said back waist part and with the other end of said second elastic member being sewn to said front waist reverse cloth, said side cloth being folded back to be sewn to a hemmed edge of said waist pocket, and a pocket bag to be opened and closed by a fastener which is provided between said front body part and said reverse cloth of said front body part.

2. The waist expanding and contracting structure for an article of clothing as claimed in claim 1, which includes a waist belt which is sewn to a part of said back waist part at its one end, and a ring for allowing said waist belt to pass therethrough which is attached to an end of said front waist surface cloth by means of a third elastic member, whereby said waist belt which has been adjusted in length can be expanded or contracted.

3. The waist expanding and contracting structure for an article of clothing as claimed in claim 2, wherein there is formed a gathered portion by sewing a fourth elastic member to a part of said back waist part, and an end of said waist belt is sewn to an end of said gathered portion thereby to cover said gathered portion.

4. The waist expanding and contracting structure for an article of clothing as claimed in claim 2, wherein said side waist part is provided with a belt loop, and said waist belt is adapted to be folded back at said ring, after said waist belt has passed through said belt loop.

5. The waist expanding and contracting structure for an article of clothing as claimed in any one of claims 2 to 4, wherein said waist belt is adapted to be fastened or detached by means of a hook and loop fastener having both male and female loops.

* * * * *